US010943718B2

(12) United States Patent
Yoshidome et al.

(10) Patent No.: US 10,943,718 B2
(45) Date of Patent: Mar. 9, 2021

(54) SOFT MAGNETIC ALLOY AND MAGNETIC DEVICE

(71) Applicant: TDK CORPORATION, Tokyo (JP)

(72) Inventors: Kazuhiro Yoshidome, Tokyo (JP); Hiroyuki Matsumoto, Tokyo (JP); Kenji Horino, Tokyo (JP); Akito Hasegawa, Tokyo (JP); Yu Yonezawa, Tokyo (JP); Syota Goto, Tokyo (JP); Hajime Amano, Tokyo (JP)

(73) Assignee: TDK CORPORATION, Tokyo (JP)

( * ) Notice: Subject to any disclaimer, the term of this patent is extended or adjusted under 35 U.S.C. 154(b) by 257 days.

(21) Appl. No.: 15/905,027

(22) Filed: Feb. 26, 2018

(65) Prior Publication Data

US 2018/0247745 A1 Aug. 30, 2018

(30) Foreign Application Priority Data

Feb. 27, 2017 (JP) ..... JP2017-035387

(51) Int. Cl.

| | |
|---|---|
| ***H01F 1/153*** | (2006.01) |
| ***C22C 45/02*** | (2006.01) |
| ***C22C 38/16*** | (2006.01) |
| ***C22C 33/00*** | (2006.01) |
| ***C22C 38/18*** | (2006.01) |
| ***C22C 38/02*** | (2006.01) |
| ***C22C 38/00*** | (2006.01) |

(Continued)

(52) U.S. Cl.

CPC ..... *H01F 1/1535* (2013.01); *C22C 33/003* (2013.01); *C22C 33/006* (2013.01); *C22C 33/04* (2013.01); *C22C 38/002* (2013.01); *C22C 38/02* (2013.01); *C22C 38/12* (2013.01); *C22C 38/16* (2013.01); *C22C 38/18* (2013.01); *C22C 45/02* (2013.01); *H01F 1/15308* (2013.01); *H01F 41/0246* (2013.01); *B22F 2998/10* (2013.01); *C22C 2200/02* (2013.01); *C22C 2202/02* (2013.01); *H01F 41/0226* (2013.01)

(58) Field of Classification Search

CPC . B22F 9/082; C22C 2200/02; C22C 2202/02; C22C 33/003; H01F 1/15308; H01F 1/1535; H01F 41/0226

See application file for complete search history.

(56) References Cited

U.S. PATENT DOCUMENTS

2005/0236071 A1 10/2005 Koshiba et al.
2009/0145524 A1* 6/2009 Ogawa ..... H01F 1/15308 148/304

(Continued)

FOREIGN PATENT DOCUMENTS

CN 104934179 * 5/2014
EP 2 149 616 A1 2/2010

(Continued)

*Primary Examiner* — Nicholas A Wang
(74) *Attorney, Agent, or Firm* — Oliff PLC

(57) ABSTRACT

Provided is a soft magnetic alloy including Fe, as a main component, and including C. the soft magnetic alloy includes an Fe composite network phase having Fe-rich grids connected in a continuous measurement range including 80000 grids, each of which size is 1 nm×1 nm×1 nm. An average of C content ratio of the Fe-poor grids having cumulative frequency of 90% or more from lower C content is 5.0 times or more to an average of C content ratio of the whole soft magnetic alloy.

15 Claims, 9 Drawing Sheets

(51) Int. Cl.

| | |
|---|---|
| ***C22C 38/12*** | (2006.01) |
| ***C22C 33/04*** | (2006.01) |
| ***H01F 41/02*** | (2006.01) |

(56) References Cited

U.S. PATENT DOCUMENTS

| | | | |
|---|---|---|---|
| 2015/0159256 | A1 | 6/2015 | Shimizu et al. |
| 2018/0166213 | A1 | 6/2018 | Making et al. |

FOREIGN PATENT DOCUMENTS

| | | | | |
|---|---|---|---|---|
| EP | 2 463 397 | A1 | | 6/2012 |
| EP | 3 301 691 | A1 | | 4/2018 |
| EP | 3 358 579 | A1 | | 8/2018 |
| JP | S63-304603 | A | | 12/1988 |
| JP | H06-10105 | A | | 1/1994 |
| JP | 2000-030924 | A | | 1/2000 |
| JP | WO2008133301 | | * | 11/2008 |
| JP | 2012-012699 | A | | 1/2012 |
| WO | 2008/133301 | A1 | | 11/2008 |
| WO | 2017/006868 | A1 | | 1/2017 |

* cited by examiner

SOFT MAGNETIC ALLOY AND MAGNETIC DEVICE

BACKGROUND OF THE INVENTION

1. Field of the Invention

The present invention relates to a soft magnetic alloy and a magnetic device.

2. Description of the Related Art

In recent years, low power consumption and high efficiency are demanded in electronic, information, communication equipment, etc. In addition, the above demands are becoming stronger towards a low carbon society. Therefore, reduction of energy loss or improvement of power supply efficiency are also required for power supply circuits of electronic, information, communication equipment, etc. In the magnetic core of the ceramic element to be used in the power supply circuit, improvement of magnetic permeability and reduction of core loss (magnetic core loss) are required. If the core loss is reduced, the loss of power energy will be reduced, thereby high efficiency and energy saving can be achieved.

Patent Document 1 describes that by changing the grain shape of the powder, the soft magnetic alloy powder having a large magnetic permeability and a small core loss, which is suitable for a magnetic core is obtained. However, at present, there is a demand for a magnetic core having larger permeability and smaller core loss.

[Patent Document 1] a brochure of JP-A-2000-30924

SUMMARY OF THE INVENTION

As a method of reducing core loss of the magnetic core, it is conceivable to reduce coercive force of the magnetic body constituting the magnetic core.

An object of the present invention is to provide such as a soft magnetic alloy having low coercive force and high production stability.

To achieve the above object, the soft magnetic alloy of the invention of the first aspect is a soft magnetic alloy including Fe, as a main component, and including C, in which a composition of the soft magnetic alloy is $Fe_aCu_bM1_cSi_dB_eC_f$, in which $a+b+c+d+e+f=100$, $0.1\leq b\leq 3.0$, $1.0\leq c\leq 10.0$, $0.0\leq d\leq 17.5$, $6.0\leq e\leq 13.0$, and $0.0<f\leq 4.0$, and M1 is one or more selected from a group_consisting of Nb, Ti, Zr, Hf, V, Ta, Mo, P and Cr, the soft magnetic alloy includes an Fe composite network phase having Fe-rich grids connected in a continuous measurement range including 80000 grids, each of which size is 1 nm×1 nm×1 nm, Fe content ratio of each of the Fe-rich grids is higher than an average of Fe content ratio of the whole soft magnetic alloy, the continuous measurement range includes Fe-poor grids among the 80000 grids, Fe content ratio of each of the Fe-poor grids is less than the average of Fe content ratio of the whole soft magnetic alloy, and an average of C content ratio of the Fe-poor grids having cumulative frequency of 90% or more from lower C content is 5.0 times or more to an average of C content ratio of the whole soft magnetic alloy.

The soft magnetic alloy of the invention according to the first aspect includes the above Fe composite network phase, and by making the distribution of C content ratio in the Fe-poor grids, coercive force tends to lower, and production stability improves.

According to the soft magnetic alloy of the present invention of the first aspect, an average of M1 content ratio of the Fe-poor grids having cumulative frequency of 90% or more from the lower C content is 1.2 times or more to an average of M1 content ratio of the whole soft magnetic alloy.

To achieve the above object, the soft magnetic alloy of the invention of the second aspect is a soft magnetic alloy including Fe, as a main component, and including C, in which a composition of the soft magnetic alloy is $Fe_\alpha M2_\beta B_\gamma C_\Omega$, in which $\alpha+\beta+\gamma+\Omega=100$, $1.0\leq\beta\leq 15.0$, $2.0\leq\gamma\leq 20.0$ and $0.0<\Omega\leq 4.0$, and M2 is one or more selected from a group consisting of Nb, Cu, Zr, Hf, Ti, V, Ta, Mo, P, Si and Cr, the soft magnetic alloy includes an Fe composite network phase having Fe-rich grids connected in a continuous measurement range including 80000 grids, each of which size is 1 nm×1 nm×1 nm, Fe content ratio of each of the Fe-rich grids is higher than an average of Fe content ratio of the whole soft magnetic alloy, the continuous measurement range includes Fe-poor grids among the 80000 grids, Fe content ratio of each of the Fe-poor grids is less than the average of Fe content ratio of the whole soft magnetic alloy, and an average of C content ratio of the Fe-poor grids having cumulative frequency of 90% or more from lower C content is 5.0 times or more to an average of C content ratio of the whole soft magnetic alloy.

The soft magnetic alloy of the invention according to the second aspect includes the above Fe composite network phase, and by making the distribution of C content ratio in the Fe-poor grids, coercive force tends to lower, and production stability improves.

According to the soft magnetic alloy of the invention of the second aspect, an average of M2 content ratio of the Fe-poor grids having cumulative frequency of 90% or more from the lower C content is 1.2 times or more to an average of M2 content ratio of the whole soft magnetic alloy.

The following description is common to the first and the second aspects of the invention.

The average of C content ratio of the whole soft magnetic alloy is preferably 3 atom % or less.

An average of B content ratio of the Fe-poor grids having cumulative frequency of 90% or more from the lower C content is 1.2 times or more to an average of B content ratio of the whole soft magnetic alloy.

The magnetic device of the present invention includes the above soft magnetic alloy.

DESCRIPTION OF THE PREFERRED EMBODIMENTS

Figure 1:
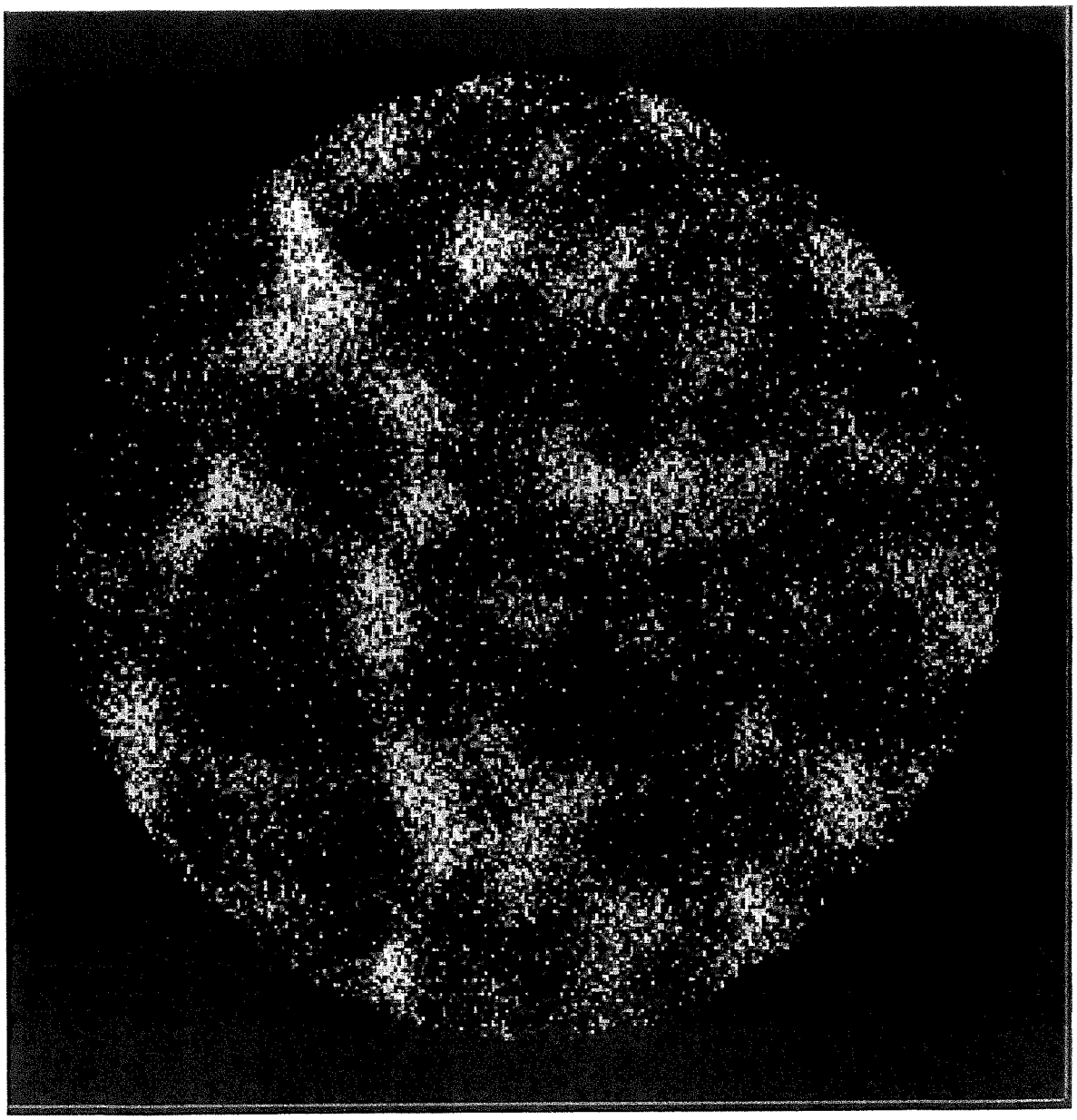
FIG. 1 is a picture of Fe concentration distribution of the soft magnetic alloy observed by three-dimensional atom probe according to an embodiment of the invention.

Hereinafter, the present invention is described based on embodiments of the invention.

The soft magnetic alloy according to the present embodiment is a soft magnetic alloy including Fe as a main component. "Fe as a main component" specifically refers to a soft magnetic alloy having Fe content of 65 atom % or more in the whole soft magnetic alloy.

The composition of the soft magnetic alloy according to the present embodiment is not particularly limited except that Fe is the main component. Fe—Si-M1-B—Cu—C based soft magnetic alloys and Fe-M2-B—C based soft magnetic alloys are exemplified, however, other soft magnetic alloys may be used.

In the following description, with respect to the content ratio of each element of the soft magnetic alloy, the whole soft magnetic alloy is determined 100 atom % in the absence of description of the population parameters in particular.

In case of using Fe—Si-M1-B—Cu—C based soft magnetic alloy, when a composition of said Fe—Si-M1-B—Cu—C based soft magnetic alloy is expressed as FeaCubM1cSidBeCf, the following formula is satisfied. When the following formula is satisfied, it tends to be easy to obtain the Fe composite network phase. In addition, it tends to be easy to obtain a soft magnetic alloy having a low coercive force. In addition, the soft magnetic alloy having the following composition is relatively inexpensive as a raw material.

$$a+b+c+d+e+f=100$$

$$0.1\leq b\leq 3.0$$

$$1.0\leq c\leq 10.0$$

$$0.0\leq d\leq 17.5$$

$$6.0\leq e\leq 13.0$$

$$0.0<f\leq 4.0$$

Cu content ratio (b) is preferably 0.1 to 3.0 atom %, and more preferably 0.5 to 1.5 atom %. In addition, the smaller the Cu content ratio, the easier it is to prepare a ribbon including the soft magnetic alloy by a single roll method described later. By adding Cu within the above range, coercive force can be lowered, and the production stability can be improved.

M1 is a transition metal element or P. M1 may be one or more selected from the group consisting of Nb, Ti, Zr, Hf, V, Ta, Mo, P and Cr. It is preferably a transition metal element, more preferably one or more selected from the group consisting of Nb, Ti, Zr, Hf, V, Ta and Mo. Further, it is further preferable to include Nb as M.

M1 content ratio (c) is preferably 1.0 to 10.0 atom %, and more preferably 3.0 to 5.0 atom %. By adding M1 within the above range, coercive force can be lowered, and the production stability can be improved.

Si content ratio (d) is preferably 0.0 to 17.5 atom %. When M=P, it is preferably 0.0 to 8.0 atom %, and when M1 is a transition metal element, it is preferably 11.5 to 17.5 atom %. By adding Si within the above range, coercive force can be lowered, and the production stability can be improved.

B content ratio (e) is preferably 6.0 to 13.0 atom %, and more preferably 9.0 to 11.0 atom %. By adding B within the above range, coercive force can be lowered, and the production stability can be improved.

C content ratio (f) is preferably 0.0 to 4.0 atom % (excluding 0.0 atom %), and more preferably 0.1 to 4.0 atom %. When C is added within the above range, coercive force can be lowered, and the production stability can be improved.

It should be noted that Fe may be a remaining part of Fe—Si-M1-B—Cu—C based soft magnetic alloy according to this embodiment.

In the case of using Fe-M2-B—C based soft magnetic alloy, it is preferable to satisfy the following formula when the composition of Fe-M2-B—C based soft magnetic alloy is expressed as $Fe_{\alpha}M2_{\beta}B_{\gamma}C_{\Omega}$. When the following formula is satisfied, it tends to be easy to obtain Fe composite network phase. In addition, it tends to be easy to obtain the soft magnetic alloy having a low coercive force. In addition, raw material of the soft magnetic alloy having the following composition is relatively inexpensive.

$$\alpha+\beta+\gamma+\Omega=100$$

$$1.0\leq\beta\leq 15.0$$

$$2.0\leq\gamma\leq 20.0$$

$$0.0\leq\Omega\leq 4.0$$

M2 is a transition metal element or P. M2 may be one or more selected from the group consisting of Nb, Cu, Zr, Hf, Ti, V, Ta, Mo, P, Si and Cr. M2 is preferably a transition metal element, more preferably one or more selected from the group consisting of Nb, Cu, Zr, Hf, Ti, V, Ta, Mo, P and Cr, and further preferably one or more selected from the group consisting of Nb, Cu, Zr, and Hf. It is further preferable that M includes one or more element selected from the group consisting of Nb, Zr and Hf.

M2 content ratio (β) is preferably 1.0 to 15.0 atom %, more preferably 1.0 to 14.1 atom %, and further more preferably 5.0 to 8.1 atom %.

Cu content ratio included in M2 is preferably 0.0 to 2.0 atom %, more preferably 0.1 to 1.0 atom %, relative to 100 atom % of the whole soft magnetic alloy. However, when M2 content ratio is less than 7.0 atom %, there is a case when it is preferable not to include Cu.

B content ratio (γ) is preferably 2.0 to 20.0 atom %. Further, when Nb is included as M2, it is preferably 4.5 to 18.0 atom %, and when Zr and/or Hf is included as M2, 2.0 to 8.0 atom % is preferable. The smaller the B content ratio, the lower the amorphous property tends to be. When B content ratio is within the predetermined range, coercive force can be lowered, and the production stability can be improved.

C content ratio (Ω) is preferably 0.1 to 5.0 atom %, more preferably 0.1 to 3.0 atom %, and more preferably 0.5 to 1.0 atom %. The addition of C tends to improve the amorphous property. When C content ratio is within the predetermined range, coercive force can be lowered, and the production stability can be improved.

Hereinafter, the Fe composite network phase included in the soft magnetic alloy according to the embodiment will be described. In the following description, M is replaced with M1 when Fe—Si-M1-B—Cu—C based soft magnetic alloy is used, and M is replaced with M2 when Fe-M2-B—C based soft magnetic alloy is used.

Figure 2:
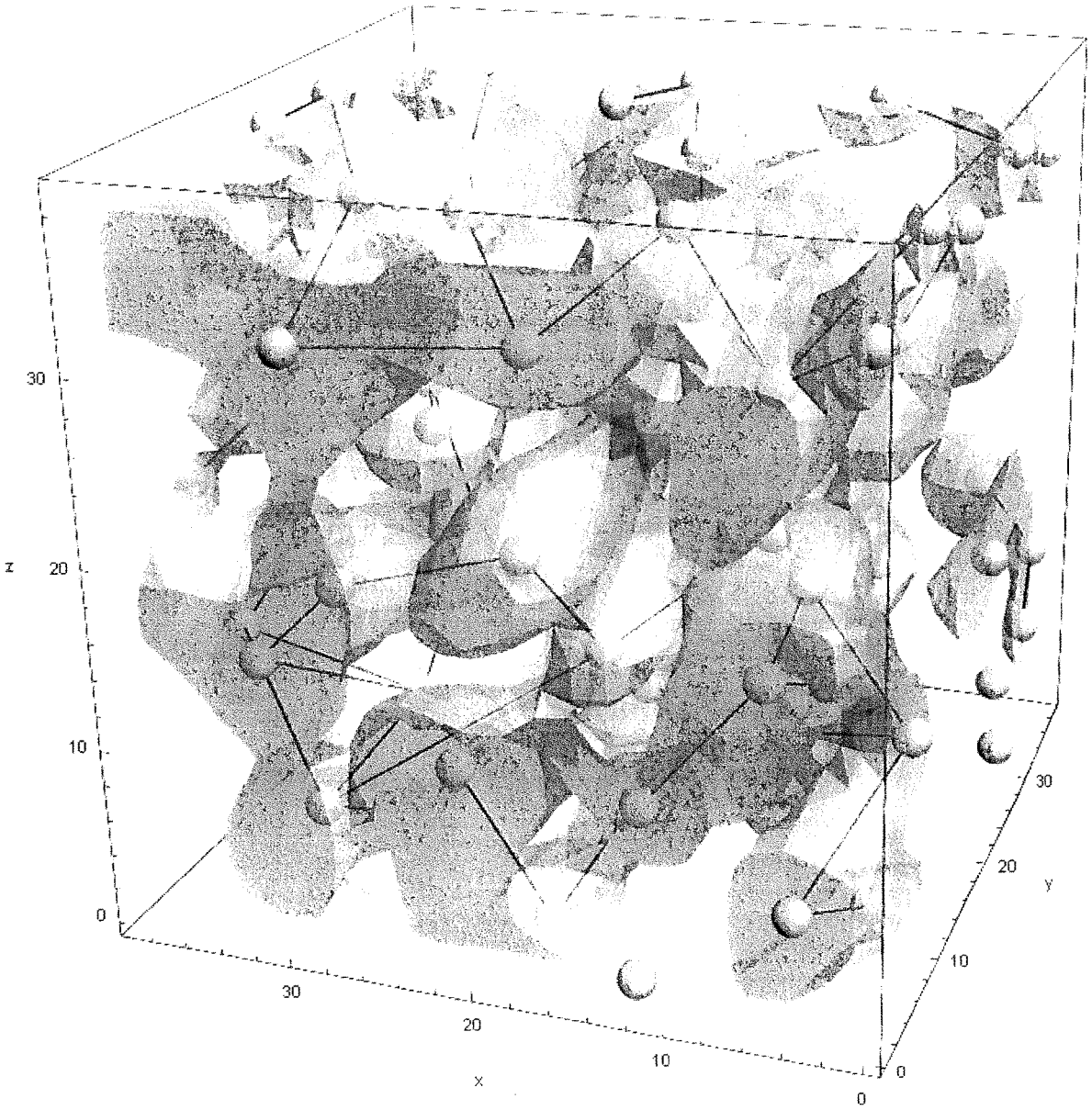
FIG. 2 is a picture of a network structure model of the soft magnetic alloy according to an embodiment of the present invention.

Fe composite network phase is a phase having Fe content ratio higher than the average composition of the soft magnetic alloy. When Fe concentration distribution of the soft magnetic alloy according to the present embodiment is observed with a thickness of 5 nm using a three-dimensional atom probe (hereinafter sometimes referred to as 3DAP), a state, in which areas with a high Fe content ratio are distributed in a network form, can be observed as in FIG. 1. FIG. 2 is a schematic diagram in which said distribution is three-dimensioned.

Conventional Fe including soft magnetic alloys had a plurality of high Fe content ratio areas of a spherical shape or an approximate spherical shape and existed separately via Fe-poor areas. The soft magnetic alloy according to the present embodiment is characterized in that the Fe-rich areas are distributed in the network form as shown in FIG. 2.

Hereinafter, a method of analyzing Fe composite network phase and criteria for judging the presence or absence of Fe network phase of the present embodiment will be described.

First, a rectangular parallelepiped having side lengths of 50 nm×40 nm×40 nm is a measurement range, and the rectangular parallelepiped is divided into cubic grids each having a side length of one nm. That is, 50×40×40=80,000 grids exist in one measurement range. With respect to the measurement range according to the present embodiment, the shape of the measurement range is not particularly limited, and it is sufficient when the final 80000 grids are present consecutively.

Next, Fe content ratio included in each grid is evaluated. Then, an average value of Fe content ratio in all grids is calculated. The average value of Fe content ratio is substantially equal to the value calculated from the average composition of each soft magnetic alloy.

Figure 3:
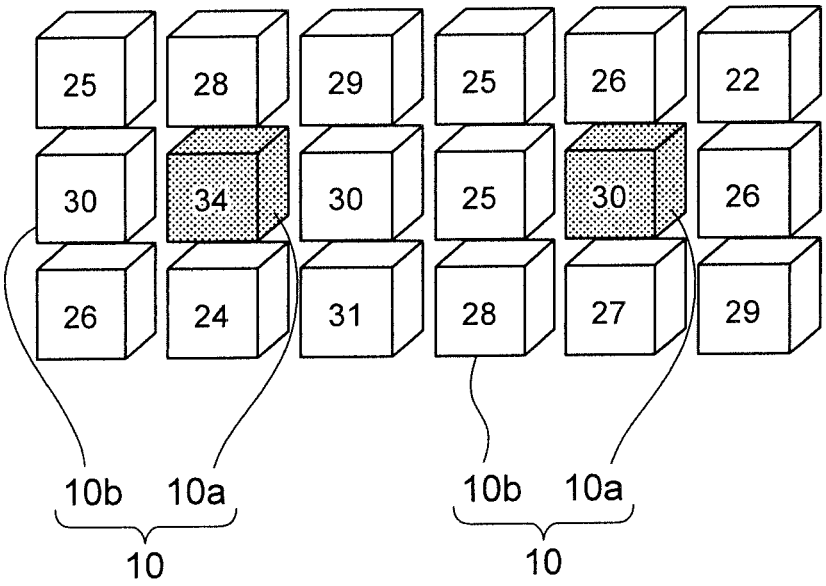
FIG. 3 is a schematic diagram of a process of searching a maximum point.

Next, a grid, whose Fe content ratio exceeds a threshold value and whose Fe content ratio is higher than all adjacent grids, is set as a maximum point. FIG. 3 shows a model showing the process of searching the maximum point. The numbers described in each grid 10 represent Fe content ratio included in each grid. A grid having Fe content ratio equal to or larger than Fe content ratio of all adjacent grids 10*b* is set as maximum point 10*a*.

In FIG. 3, eight adjacent grids 10*b* are shown around one maximum point 10*a*, but nine adjacent grids 10*b* are also located in front and at the back of maximum point 10*a*, respectively. That is, there are 26 adjacent grids 10*b* for one maximum point 10*a*.

For grid 10 located at the end of measurement range, it is assumed that a grid with zero Fe content ratio exists outside the measurement range.

Figure 4:
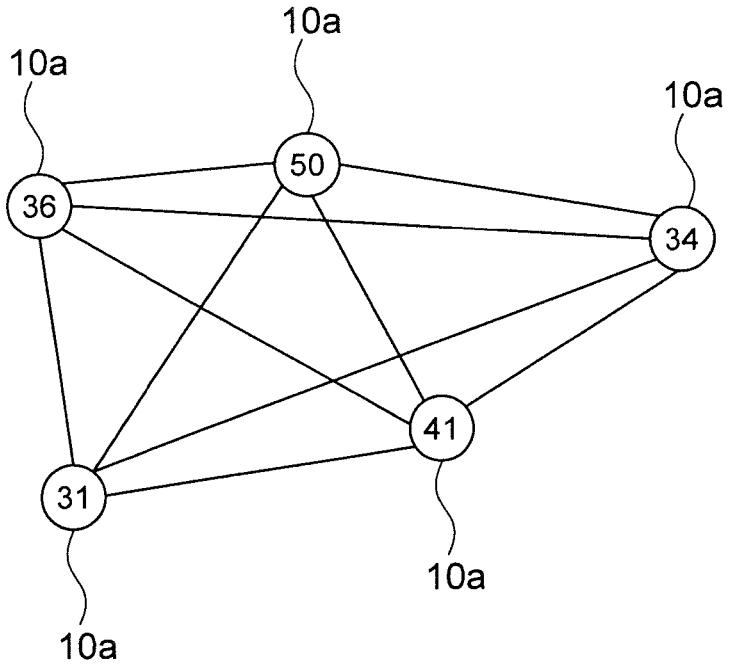
FIG. 4 is a schematic diagram of a state in which a line segment connecting all the maximum points is generated.

Next, as shown in FIG. 4, line segments connecting between all maximum points 10*a* included in the measurement range are drawn. When connecting the line segments, centers of each grid is connected. In FIGS. 4 to 7, the maximum point 10*a* is described as a circle for convenience of explanation. The number written inside the circle is Fe content ratio.

Figure 5:
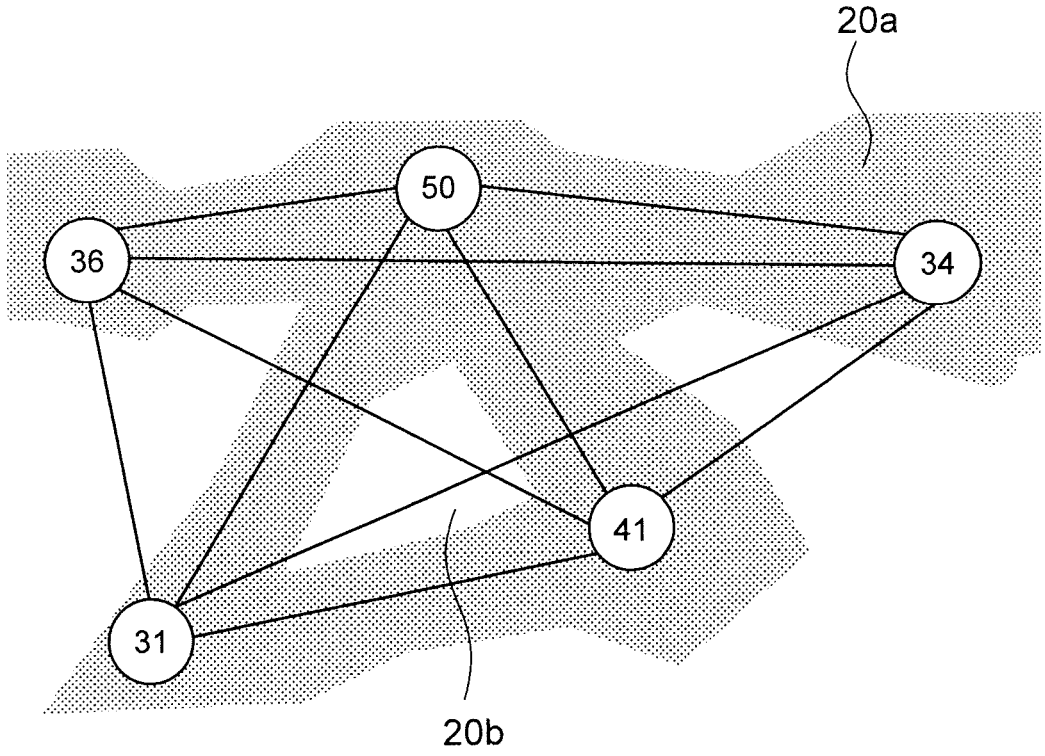
FIG. 5 is a schematic diagram showing a state separating Fe-rich grids and Fe-poor grids.
Figure 6:
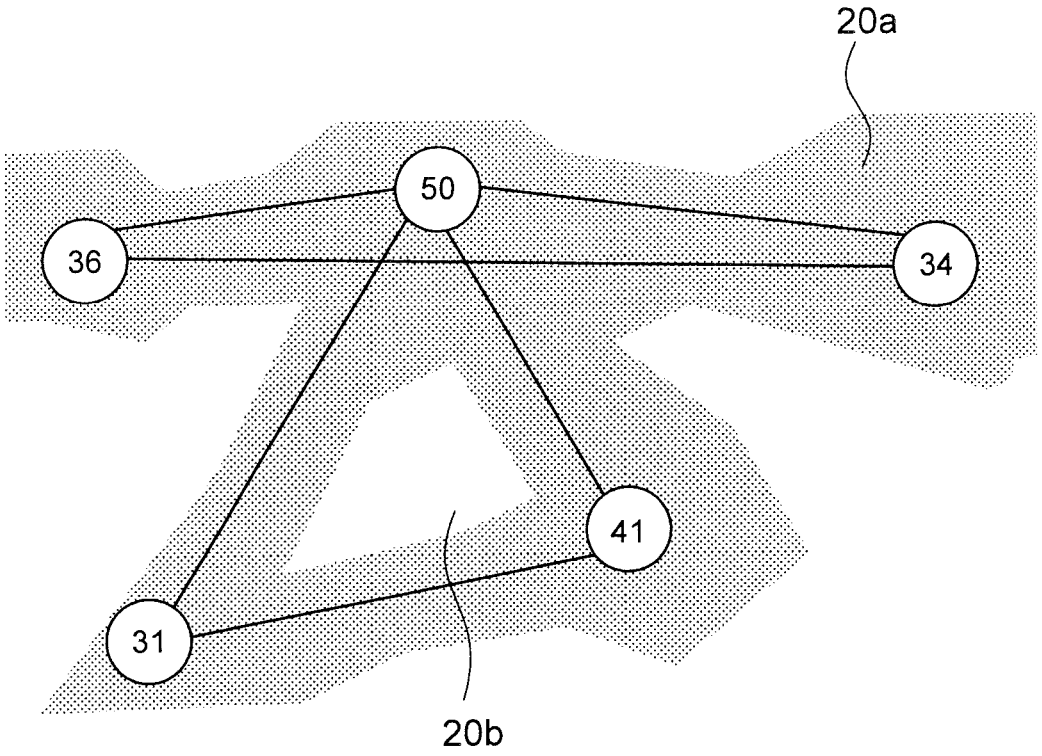
FIG. 6 is a schematic diagram of a state in which a line segment passing through the Fe-poor grids is deleted.

Next, as shown in FIG. 5, an area (=Fe composite network phase) 20*a* having an Fe content ratio higher than the threshold value and area 20*b* having Fe content ratio of threshold value or less are separated. Then, as shown in FIG. 6, the line segment passing through area 20*b* is deleted.

Figure 7:
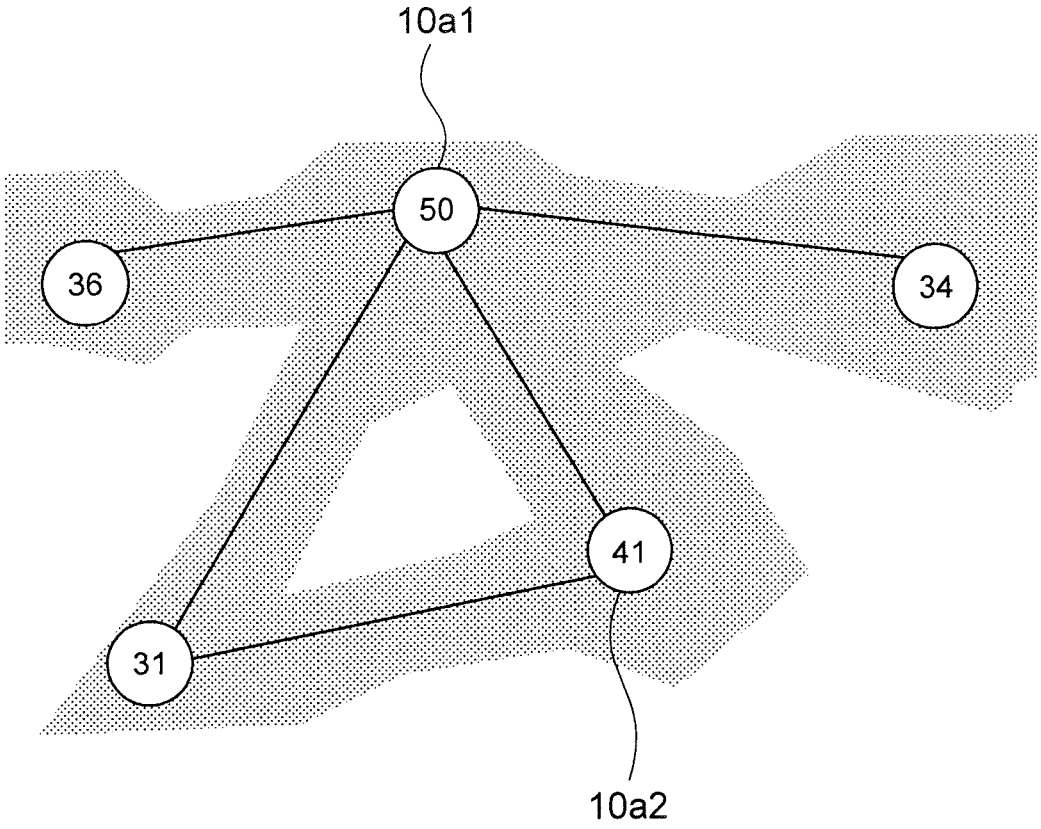
FIG. 7 is a schematic diagram of a state in which the longest line segment among the line segments forming a triangle is deleted, when there is no area of Fe-poor grids inside the triangle.

Next, as shown in FIG. 7, when the line segments constitute a triangle and area 20*b* does not exist inside the triangle, the longest one line segment among the three line segments constituting the triangle is deleted. Finally, when the maximum points are in adjacent grids, the line segment connecting said maximum points is deleted.

Then, number of line segments extending from each maximum point 10*a* is a coordination number of each maximum point 10*a*. For example, in case of FIG. 7, the maximum point 10*a*1 at which Fe content ratio is 50 has the coordination number of four, and the maximum point 10*a*2 at which Fe content ratio is 41 has the coordination number of two.

In addition, when grid existing on the outermost surface of the measurement range of 50 nm×40 nm×40 nm indicates the maximum point, the maximum point is excluded from the calculation of ratio of the maximum point where the coordination number described later is within a specific range.

It is assumed that Fe composite network phase also includes a maximum point having a coordination number of zero and an area having Fe content ratio higher than the threshold value existing around the maximum point having the coordination number of zero.

By performing the measurement described above several times, each in different measurement ranges, the accuracy of the calculated result can be made sufficiently high. Preferably, measurement is performed three or more times, each in different measurement ranges.

The soft magnetic alloy according to the present embodiment includes Fe composite network phase, when the alloy includes 400,000 pieces/$\mu m^3$ or more maximum points, in which Fe content ratio becomes locally higher than the surroundings, and when ratio of the maximum point having coordination number of one or more and five or less with respect to the whole maximum point of Fe content ratio is 80% or more and 100% or less.

Figure 9:
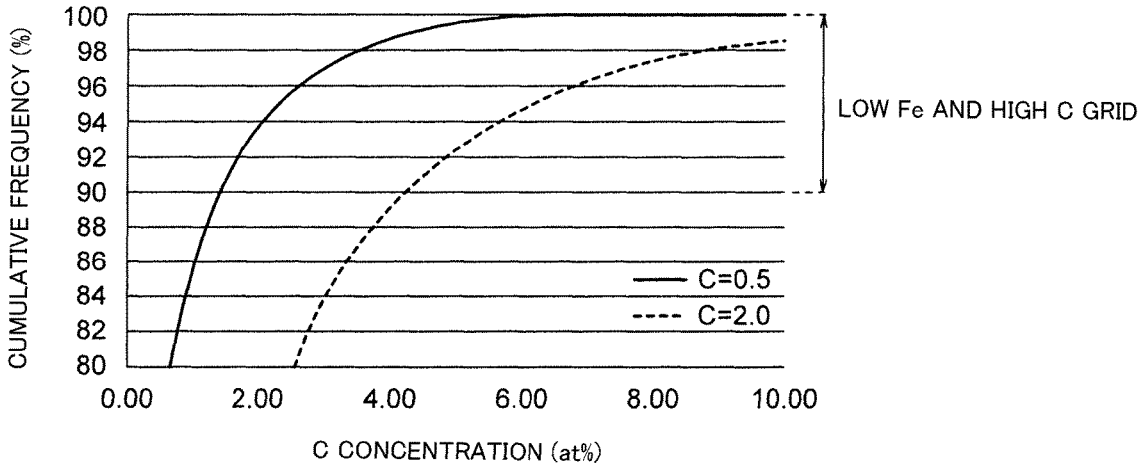
FIG. 9 is a graph showing the relationship between carbon concentration and cumulative frequency.

Further, according to the soft magnetic alloy of the present embodiment, C content ratio is measured in a grid (a grid including Fe amount less than the average of the whole soft magnetic alloy: Fe-poor grid) having an Fe amount less than the threshold value, and a cumulative frequency function shown in FIG. 9 was drawn. The average value of C amount in a grid having a cumulative frequency of 90% or more (hereinafter sometimes referred to as a low Fe and high C grid) is 5.0 times or more than the average value of C content ratio of the whole soft magnetic alloy, and is preferably 6.0 times or more, and further preferably 7.0 times or more than the average value of C content ratio with respect to the whole soft magnetic alloy. There is no upper limit to the average value of C content ratio in the low Fe and high C grid, but it is usually less than 30 times the average value of C content ratio of the whole soft magnetic alloy. The cumulative frequency function shown in FIG. 9 is the cumulative frequency functions of Examples 5 and 6a, described hereinafter. In FIG. 9, the area with the cumulative frequency of less than 80% is omitted.

The soft magnetic alloy according to the embodiment includes Fe composite network phase and further includes the above C amount distribution, that is, because C segregates in a place where Fe content ratio is small, it is possible to decrease coercive force and improve production stability. It should be noted that the production stability here means a property that a soft magnetic alloy having low coercive force can be stably produced even if the manufacturing conditions are varied. In the soft magnetic alloy according to the present embodiment, the stability against variations in the heat treatment temperature described hereinafter is high, and low coercive force can be maintained particularly even when heat treatment is performed at a high temperature.

Further, in the soft magnetic alloy according to the present embodiment, it is preferable that the average C content ratio of the whole soft magnetic alloy is 3 atom % or less. When C content ratio is 3 atom % or less, coercive force can be further lowered. The average C content ratio of the whole soft magnetic alloy is preferably 0.1 atom % or more and 3 atom % or less, and more preferably 0.5 atom % or more and 1.0 atom % or less.

Furthermore, in the soft magnetic alloy according to the present embodiment, it is preferable that the average B content ratio in the low Fe and high C grid is 1.20 times or more than the average B content ratio of the whole soft magnetic alloy.

Furthermore, in the soft magnetic alloy according to the present embodiment, it is preferable that the average M content ratio in the low Fe and high C grid is 1.20 times or more the average M content ratio of the whole soft magnetic alloy.

In case when distribution of B content ratio and/or M content ratio in the soft magnetic alloy exhibits the above distribution, that is, when B and/or M segregate in a pace where Fe content ratio is small, it becomes easy to suppress the generation of boride in which Fe atoms and B atoms are bonded to each other, so that coercive force is easily lowered and soft magnetic alloy having high production stability can be easily formed. Generation of boride is suppressed because C atoms and M atoms (especially Nb atom) are easy to bond, and M atoms (especially Nb atoms) and B atoms tend to bond easily. That is, it is considered that when C atoms and further B atoms and M atoms are segregated in areas where the content ratio of Fe atoms is small, the amount of B atoms forming the boride by bonding with Fe atom decreases.

Hereinafter, a method of manufacturing the soft magnetic alloy according to the present embodiment will be described The method of manufacturing the soft magnetic alloy according to the present embodiment is not particularly limited. For example, there is a method of manufacturing a ribbon of a soft magnetic alloy of the present embodiment by such as a single roll method.

In the single roll method, first, pure metals of each metal element included in the finally obtained soft magnetic alloy are prepared and weighed to have the same composition as the finally obtained soft magnetic alloy. Then, pure metals of each metal element are dissolved and mixed to prepare a mother alloy. The method of dissolving the pure metal is not particularly limited, but there is a method of dissolving the pure metal by high-frequency heating after vacuum evacuation in the chamber, for example. Incidentally, the mother alloy and the finally obtained soft magnetic alloy usually have the same composition.

Next, the prepared mother alloy is heated and melted to obtain a molten metal. The temperature of the molten metal is not particularly limited, but may be, for example, 1200 to 1500° C.

Figure 8:
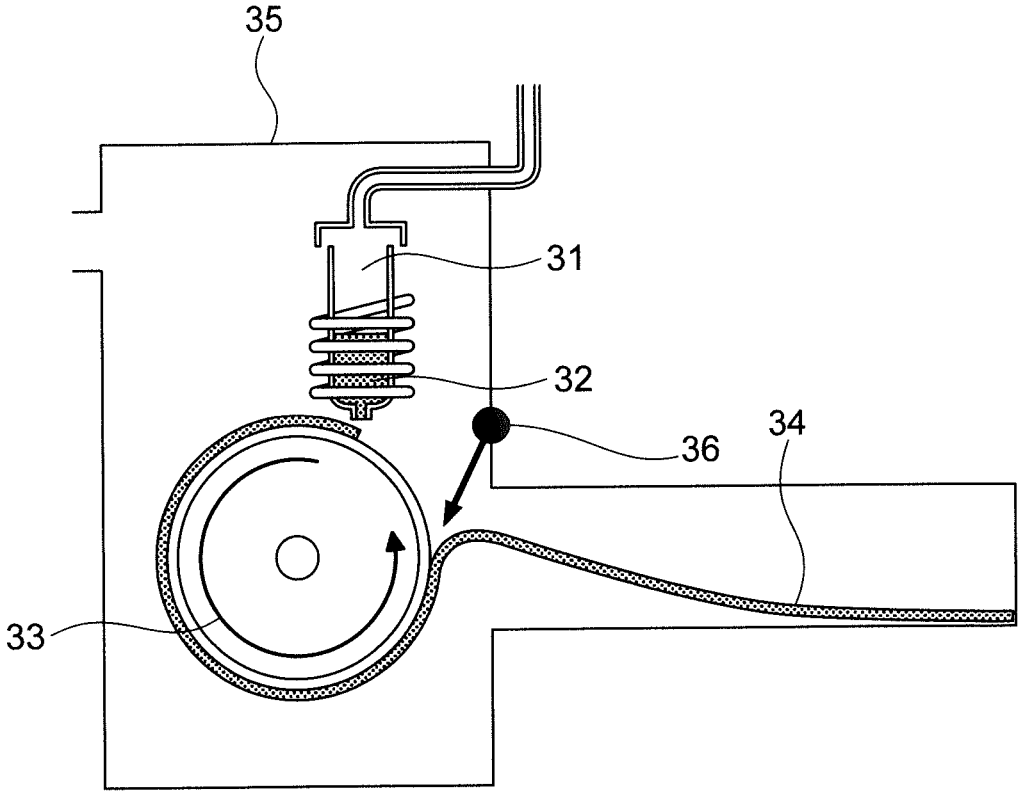
FIG. 8 is a schematic diagram of a single roll method.

A schematic diagram of an apparatus used for the single roll method is shown in FIG. 8. In the single roll method according to the present embodiment, molten metal 32 is injected and supplied from nozzle 31 to roll 33, rotating in the arrow direction, so that ribbon 34 is prepared in the rotational direction of roll 33. In this embodiment, the material of roll 33 is not particularly limited. For example, a roll including Cu is used.

Further, the rotational direction of roll 33 in FIG. 8 is opposite to the rotational direction of a general roll. By rotating in the direction opposite to the general rotational direction of the roll, the time during which roll 33 and ribbon 34 contact becomes long, and ribbon 34 can be rapidly cooled.

Further, as an advantage of rotating roll 33 in the direction shown in FIG. 8, it is possible that the strength of cooling by roll 33 can be controlled by controlling gas pressure of the peel gas injected from peel gas injector 36 shown in FIG. 8. For example, by increasing gas pressure of the peel gas, it is possible to shorten the time during which roll 33 and ribbon 34 are in contact and to weaken the cooling. Conversely, weakening gas pressure of the peel gas makes it possible to lengthen the time during which roll 33 and ribbon 34 are in contact, and to strengthen the cooling.

In the single roll method, it is possible to adjust the thickness of the ribbon obtained by mainly adjusting the rotational speed of roll 33. However, for example, it is possible to adjust the thickness of the obtained ribbon by adjusting a gap between nozzle 31 and roll 33, the temperature of the molten metal, etc. Thickness of the obtained ribbon is not particularly limited, but it may be 15 to 30 μm.

It is preferable that the ribbon is amorphous before the latter mentioned heat treatment. By applying the heat treatment described later to the amorphous ribbon, the above-mentioned Fe composite network phase can be obtained.

The method of confirming whether the ribbon of the soft magnetic alloy before the heat treatment is amorphous or not is not particularly limited. Here, the amorphous ribbon means that crystals are not included in the ribbon. For example, the presence or absence of crystals having a grain diameter of approximately 0.01 to 10 μm can be confirmed by a general X-ray diffraction measurement. In this embodiment, when it can be confirmed that crystals are present by the general X-ray diffraction measurement, an Fe composite network phase cannot be obtained after the heat treatment.

The temperature of roll 33 and the vapor pressure inside chamber 35 are not particularly limited. For example, the temperature of roll 33 may be set to 50 to 70° C. and the vapor pressure inside chamber 35 may be set to 11 hPa or less by using Ar gas in which dew point has been adjusted.

Conventionally, in the single roll method, it was considered preferable to increase the cooling rate and rapidly cool molten metal 32. It was also considered preferable that increasing the temperature difference between molten metal 32 and roll 33 can improve the cooling rate. Therefore, it was generally thought that the temperature of roll 33 is preferably approximately 5 to 30° C. However, the present inventors have found that, by setting the temperature of roll 33 to 50 to 70° C., which is higher than that of conventional single roll method, and further setting the vapor pressure inside chamber 35 to 4 hPa or less, it was found that molten metal 32 is evenly cooled, and the ribbon before heat treatment of the obtained soft magnetic alloy can be made uniform amorphous. The lower limit of vapor pressure inside the chamber is not particularly limited. The vapor pressure may be 1 hPa or less by filling dew point adjusted argon or the vapor pressure may be one hPa or less as a state close to vacuum.

By heat treating the obtained ribbon 34, the above-mentioned Fe composite network phase can be obtained. Furthermore, it becomes easier to obtain the distributions of the above-mentioned C content ratio, B content ratio and M content ratio. At this time, when ribbon 34 is amorphous, the above-mentioned Fe composite network phase can be easily obtained.

The heat treatment conditions are not particularly limited. Preferable heat treatment conditions differ depending on the composition of the soft magnetic alloy. The preferred heat treatment temperature is approximately 450 to 600° C. However, in consideration of the production stability, it is preferable to suppress the generation of boride and keep coercive force low even when heat treatment temperature is raised. However, the generation temperature of the boride varies depending on the composition, so there are cases in which a preferable heat treatment temperature is outside the above range.

Also, the heat treatment time is not particularly limited. The preferable heat treatment time is 10 to 180 minutes, more preferably 60 to 180 minutes. However, depending on the composition, a preferable heat treatment time may be outside the above range. By controlling the heat treatment time within the above range, B atoms and M atoms tend to segregate at areas where Fe content ratio is small, so that coercive force can be lowered and production stability can be improved.

As a method of obtaining the soft magnetic alloy according to the embodiment, there is a method of obtaining a powder of a soft magnetic alloy according to the embodiment by a water atomizing method or a gas atomizing method, in addition to the above mentioned single roll method. The gas atomizing method will be described below.

In the gas atomizing method, a molten alloy of 1200 to 1500° C. is obtained in the same manner as the above single roll method. Thereafter, the molten alloy is injected in the chamber to prepare a powder.

At the time, by setting the gas injection temperature to 50 to 100° C. and setting the vapor pressure in the chamber to 4 hPa or less, it is easy to finally obtain the above preferable Fe composite network phase.

Heat treatment is carried out at 550 to 650° C. for 10 to 180 minutes after preparing the powder by gas atomizing method. Thus, the diffusion of elements is promoted while preventing the powder from being coarsened by sintering the powders, the thermodynamic equilibrium state can be reached in a short time, distortion and stress can be removed and Fe composite network phase can be easily obtained. Then, soft magnetic alloy powder having good soft magnetic properties can be obtained especially in high frequency region.

Although one embodiment of the present invention has been described above, the present invention is not limited to the above embodiment.

The shape of the soft magnetic alloy according to the present embodiment is not particularly limited. As described above, a ribbon shape or powder shape is exemplified, and in addition, a block shape, etc. are also conceivable.

The application of the soft magnetic alloy according to the present embodiment is not particularly limited and can be suitably applied to the magnetic devices. A magnetic core can be exemplified as the magnetic devices. The soft magnetic alloy according to the present embodiment can be suitably used as a magnetic core for an inductor, particularly for a power inductor. In addition to the magnetic core, the soft magnetic alloy according to the present embodiment can also be suitably used for the magnetic devices such as a thin film inductor, a magnetic head, and a transformer.

Hereinafter, a method of obtaining the magnetic core and the inductor from the soft magnetic alloy according to the present embodiment will be described, but the method of obtaining the magnetic core and the inductor from the soft magnetic alloy according to the present embodiment is not limited to the following method.

As a method for obtaining a magnetic core from a ribbon shaped soft magnetic alloy, for example, a method of winding a ribbon shaped soft magnetic alloy or a method of laminating the same can be mentioned. In case of laminating the ribbon shaped soft magnetic alloys via an insulator at the time of lamination, it is possible to obtain a magnetic core with further improved properties.

As a method for obtaining the magnetic core from the soft magnetic alloy of a powdery state, pressing method using a press mold after mixing with an appropriate binder is exemplified. Also, by subjecting an oxidation treatment, an insulating coating, etc. to the powder surface before mixing with the binder, specific resistance improves, and it becomes a magnetic core suitable for a higher frequency band.

Pressing method is not particularly limited, and a pressing, a mold pressing, etc. using a press mold is exemplified. Kind of binder is not particularly limited, and silicone resins are exemplified. A mixing ratio of the soft magnetic alloy powder and binder is not particularly limited. For example, 1 to 10 mass % of binder is mixed with 100 mass % of the soft magnetic alloy powder.

For example, by mixing 1 to 5 mass % of binder with 100 mass % of the soft magnetic alloy powder and performing compression molding using the press mold, a magnetic core having a space factor (powder filling rate) of 70% or more, magnetic flux density of 0.4 T or more when a magnetic field of $1.6\times10^4$ A/m is applied and specific resistance of one Ω·cm or more can be obtained. The above characteristics are superior to general ferrite magnetic cores.

Further, For example, by mixing 1 to 3 mass % of binder with 100 mass % of the soft magnetic alloy powder and performing compression molding using the press mold under a temperature condition not lower than the softening point of the binder, a magnetic core having a space factor of 80% or more, magnetic flux density of 0.9 T or more when a magnetic field of $1.6\times10^4$ A/m is applied and specific resistance of 0.1 Ω·cm or more can be obtained. The above characteristics are superior to general ferrite magnetic cores.

Furthermore, by subjecting a green compact forming the above magnetic core to heat treatment after pressing as strain relieving heat treatment, the core loss further decreases and the usefulness is enhanced.

Inductance components can be obtained by applying wire on the above magnetic core. Methods to prepare the wire and to prepare inductance components are not particularly limited. For example, a method of winding the wire around the magnetic core prepared by the above method for at least one turn or more can be exemplified.

Furthermore, when soft magnetic alloy particles are used, there is a method of preparing inductance components by pressing and integrating in a state in which a winding coil is stored in a magnetic material. In this case, it is easy to obtain an inductance component corresponding to high frequency and large current.

Furthermore, in the case of using soft magnetic alloy particles, a soft magnetic alloy paste, in which binder and solvent are added to the soft magnetic alloy and pasted thereof, and a conductive paste, in which binder and solvent are added to the conductor metal for the coil, are alternatively printed and laminated, then heated and fired, and an inductance component can be obtained. Alternatively, a soft magnetic alloy sheet is prepared by using a soft magnetic alloy paste, a conductor paste is printed on the surface of the soft magnetic alloy sheet, and they were laminated and fired, whereby an inductance component in which a coil is stored in a magnetic body can be obtained.

Here, in case of preparing an inductance component using soft magnetic alloy particles, it is preferable to use the soft magnetic alloy powder having a maximum grain diameter of 45 μm or less and a center grain diameter (D50) of 30 μm or less, in terms of sieve diameter, to obtain superior Q characteristics. To make the maximum grain diameter 45 μm or less in terms of sieve diameter, a sieve with a mesh size of 45 μm may be used, and only the soft magnetic alloy powder passing through the sieve may be used.

As the soft magnetic alloy powder having a large maximum grain diameter is used, the Q value in a high frequency area tends to decrease. Particularly, in case of using the soft magnetic alloy powder having a maximum grain diameter exceeding 45 μm, in terms of sieve diameter, Q value may decrease greatly in high frequency area. However, when Q value in high frequency area is not valued, it is possible to use a soft magnetic alloy powder having large variations. Since soft magnetic alloy powder having large variations can be produced with a relatively low cost, it is possible to reduce the cost when soft magnetic alloy powder with large variation is used.

EXAMPLE

Hereinafter, the present invention will be specifically described based on examples.

Experiment 1

Pure metal materials were each weighed so that a mother alloy having the composition of each sample shown in Table 1 was obtained. After vacuum evacuation in the chamber, pure metal materials were melted by high frequency heating and prepared the mother alloy.

Thereafter, 50 g of the prepared mother alloy was heated and melted to obtain a metal in a molten state at 1300° C. Then the above metal was injected onto a roll by a single roll method shown in FIG. 8 under a specified roll temperature and a specified steam pressure and formed a ribbon. The material of the roll was Cu. The single roll method was performed under Ar atmosphere, rotational speed of the roll at 25 m/s, differential pressure of 105 kPa, 5 mm slit nozzle diameter, flow amount of 50 g, and roll diameter of φ 300 mm, and obtained a ribbon having a thickness of 20 to 30 μm, a width of four to five mm, and a length of several tens of meters. Next, each prepared ribbon was subjected to a heat treatment to obtain a single plate sample.

The differential pressure is the difference between the pressure near roll 33 (inside of chamber 35) and the pressure inside nozzle 31. Due to the presence of the differential pressure, molten metal is injected from nozzle 31 to roll 33.

In Experiment 1, temperature of the roll was set 50° C., vapor pressure was set to 4 hPa, and heat treatment time was set to 60 minutes, and then peel injection pressure (rapid cooling ability), C content ratio, and heat treatment temperature during heat treatment were varied and prepared each sample shown in Tables 1 to 4. The vapor pressure was adjusted by using Ar gas with dew point adjustment.

In addition, X-ray diffraction measurement was performed on each ribbon before the heat treatment, and presence or absence of crystals was confirmed. Furthermore, the transmission electron microscope was used to observe the restricted visual field diffraction image and the bright field image of 300,000 magnification, and the presence or absence of microcrystals was confirmed. As a result, it was confirmed that crystals and microcrystals were not present in the ribbons of each example and were amorphous.

Then, with respect to each sample after each ribbon was heat treated, it was confirmed that each sample includes Fe composite network phase using 3DAP (3-dimensional atom probe). Furthermore, an average C amount in the low Fe and high C grid with respect to the average C amount of the entire soft magnetic alloy was measured. Further, coercive force Hc was measured. The results are shown in Tables 1 to 4. It was determined good when coercive force Hc was 15 A/m or less when heat treated at 550° C. and 600° C., and 25 Am or less when heat treated at 650° C. was determined preferable. Further, it is preferable that coercive force Hc is always 15 A/m or less in the range of 550° C. to 650° C. And it is more preferable that coercive force Hc is always 10 A/m or less at all times within the range of 550° C. to 650° C.

TABLE 1

| Sample No. | Composition | Release Injection Pressure (MPa) | Heat Treatment Time (min) | Fe Network Phase | Coercive Force Hc(A/m) 550° C. | 600° C. | 650° C. | Low Fe and High C Grid C times | B times 600° C. | M times |
|---|---|---|---|---|---|---|---|---|---|---|
| Comp. Ex. 1 | $(Fe_{84}Nb_7B_9)_{99.0}C_{1.0}$ | 0.2 | 60 | ○ | 7.3 | 7.8 | 156 | 3.9 | 1.11 | 1.13 |
| Ex. 1 | $(Fe_{84}Nb_7B_9)_{99.0}C_{1.0}$ | 0.3 | 60 | ○ | 7.3 | 6.8 | 8.5 | 7.8 | 1.42 | 1.30 |
| Comp. Ex. 2 | $(Fe_{84}Nb_7B_9)_{99.0}C_{1.0}$ | 0.4 | 60 | ○ | 7.3 | 24 | 103 | 3.2 | 1.52 | 1.63 |
| Comp. Ex. 3 | $Fe_{84}Nb_7B_9$ | 0.3 | 60 | ○ | 20 | 10 | 63 | — | 1.34 | 1.22 |
| Ex. 4 | $(Fe_{84}Nb_7B_9)_{99.0}C_{0.1}$ | 0.3 | 60 | ○ | 8.3 | 7.2 | 9.4 | 12.3 | 1.33 | 1.40 |
| Ex. 5 | $(Fe_{84}Nb_7B_9)_{99.0}C_{0.5}$ | 0.3 | 60 | ○ | 7.1 | 5.0 | 6.9 | 7.7 | 1.44 | 1.34 |
| Ex. 6 | $(Fe_{84}Nb_7B_9)_{99.0}C_{1.0}$ | 0.3 | 60 | ○ | 7.3 | 6.8 | 8.5 | 7.2 | 1.38 | 1.32 |
| Ex. 6A | $(Fe_{84}Nb_7B_9)_{98.0}C_{2.0}$ | 0.3 | 60 | ○ | 7.6 | 7.0 | 9.3 | 7.0 | 1.40 | 1.35 |
| Ex. 7 | $(Fe_{84}Nb_7B_9)_{97.0}C_{3.0}$ | 0.3 | 60 | ○ | 9.0 | 11 | 15 | 6.3 | 1.32 | 1.30 |
| Ex. 8 | $(Fe_{84}Nb_7B_9)_{95.0}C_{5.0}$ | 0.3 | 60 | ○ | 10 | 13 | 23 | 5.2 | 1.33 | 1.29 |
| Comp. Ex. 4 | $(Fe_{84}Nb_7B_9)_{93.0}C_{7.0}$ | 0.3 | 60 | ○ | 23 | 35 | 74 | 3.2 | 1.33 | 1.28 |

In the examples, in which average C content ratio in the low Fe and high C grid when heat treated at 600° C. was 5.0 times or more the average C content ratio of the whole soft magnetic alloy, coercive force Hc showed good value regardless of the heat treatment temperature. On the other hand, in the comparative examples in which the average C content ratio in the low Fe and high C grid was less than 5.0 times the average C content ratio of the whole soft magnetic alloy, all coercive force Hc did not show a good value. Coercive force Hc of Examples 1 to 7, in which the average C content ratio of the whole soft magnetic alloy was 3.0 atom % or less, were preferable as compared with the same of Example 8, in which the average C content ratio of the whole soft magnetic alloy exceeds 3.0 atom %.

The ratio of the average C content ratio in the low Fe and high C grid to the average C content ratio in the whole soft magnetic alloy did not show a great change from the case of heat treatment at 600° C., to the case of heat treatment at 550° C. or 650° C.

Experiment 2

Composition of the mother alloy was the same as in Example 5, and only the heat treatment time was varied in the range of one minute to 180 minutes to prepare each example. Results are shown in Table 2.

TABLE 2

| Sample No. | Composition | Release Injection Pressure (MPa) | Heat Treatment Time (min) | Fe Network Phase | Coercive Force Hc(A/m) 550° C. | 600° C. | 650° C. | Low Fe and High C Grid C times | B times 600° C. | M times |
|---|---|---|---|---|---|---|---|---|---|---|
| Ex. 9 | $(Fe_{84}Nb_7B_9)_{99.5}C_{0.5}$ | 0.3 | 1 | ○ | 12 | 10 | 12 | 5.2 | 1.13 | 1.14 |
| Ex. 10 | $(Fe_{84}Nb_7B_9)_{99.5}C_{0.5}$ | 0.3 | 10 | ○ | 9.2 | 9.3 | 10 | 6.3 | 1.25 | 1.19 |
| Ex. 5 | $(Fe_{84}Nb_7B_9)_{99.5}C_{0.5}$ | 0.3 | 60 | ○ | 7.1 | 5.0 | 6.9 | 7.7 | 1.44 | 1.34 |
| Ex. 11 | $(Fe_{84}Nb_7B_9)_{99.5}C_{0.5}$ | 0.3 | 60 | ○ | 8.3 | 7.7 | 7.6 | 7.8 | 1.44 | 1.34 |
| Ex. 12 | $(Fe_{84}Nb_7B_9)_{99.5}C_{0.5}$ | 0.3 | 120 | ○ | 8.5 | 8.2 | 9.2 | 8.0 | 1.52 | 1.49 |
| Ex. 13 | $(Fe_{84}Nb_7B_9)_{99.5}C_{0.5}$ | 0.3 | 180 | ○ | 9.0 | 8.3 | 9.4 | 8.2 | 1.87 | 1.61 |

From Table 2, in each example, in which the average C content ratio in the low Fe and high C grid was 5.0 times or more the average C content ratio of the whole soft magnetic alloy, coercive force Hc was good. In the example in which average B content ratio in the low Fe and high C grid was 1.20 times or more the average B content ratio of the whole soft magnetic alloy, coercive force Hc was further good. Further, in the example, in which the average M content ratio in the low Fe and high C grid was 1.20 times or more the average M content ratio of the whole soft magnetic alloy, coercive force Hc was further good.

Experiment 3

Experiments were conducted under the same conditions as in Experiment 1 except composition of the soft magnetic alloy was varied. Experiments were conducted by varying heat treatment temperature between 550° C. and 650° C. in increments of 50° C. Table 3 shows coercivity variation with heat treatment temperature variation. Magnification of each element in low Fe and high C grid at 600° C. is shown in Table 3. In Table 4, experiments were carried out between 450° C. and 650° C. in increments of 50° C. Temperature at which coercive force was the minimum was taken as a suitable temperature. Coercive force at plus or minus 50° C. of the suitable temperature and magnification of each element in the low Fe and high C grid at the suitable temperature are shown.

TABLE 3

| Sample No. | Composition | Release Injection Pressure (MPa) | Heat Treatment Time (min) | Fe Network Phase | Coercive Force Hc(A/m) 550° C. | 600° C. | 650° C. | Low Fe and High C Grid C times 600° C. | B times 600° C. | M times 600° C. |
|---|---|---|---|---|---|---|---|---|---|---|
| Ex. 21 | $Fe_{85}Nb_5B_9C_1$ | 0.3 | 60 | ○ | 10 | 12 | 12 | 7.6 | 1.46 | 1.65 |
| Ex. 22 | $Fe_{83}Nb_7B_9C_1$ | 0.3 | 60 | ○ | 5.8 | 5.4 | 6.3 | 7.3 | 1.46 | 1.35 |
| Ex. 23 | $Fe_{80}Nb_{10}B_9C_1$ | 0.3 | 60 | ○ | 5.5 | 5.2 | 5.7 | 7.4 | 1.43 | 1.25 |
| Ex. 24 | $Fe_{76}Nb_{14}B_9C_1$ | 0.3 | 60 | ○ | 5.6 | 4.3 | 5.2 | 7.8 | 1.47 | 1.21 |
| Ex. 25 | $Fe_{87}Nb_7B_5C_1$ | 0.3 | 60 | ○ | 10 | 9.4 | 10 | 7.6 | 1.67 | 1.34 |
| Ex. 26 | $Fe_{84}Nb_7B_8C_1$ | 0.3 | 60 | ○ | 5.3 | 5.4 | 5.9 | 7.3 | 1.52 | 1.32 |
| Ex. 27 | $Fe_{81}Nb_7B_{11}C_1$ | 0.3 | 60 | ○ | 4.9 | 4.7 | 5.3 | 7.4 | 1.32 | 1.37 |
| Ex. 28 | $Fe_{75}Nb_7B_{17}C_1$ | 0.3 | 60 | ○ | 4.2 | 3.7 | 4.4 | 7.8 | 1.20 | 1.25 |
| Ex. 29 | $Fe_{83.9}Cu_{0.1}Nb_7B_8C_1$ | 0.3 | 60 | ○ | 4.3 | 3.6 | 3.9 | 7.3 | 1.52 | 1.35 |
| Ex. 30 | $Fe_{80.9}Cu_{0.1}Nb_{10}B_8C_1$ | 0.3 | 60 | ○ | 4.2 | 3.5 | 4.2 | 7.5 | 1.45 | 1.28 |
| Ex. 31 | $Fe_{76.9}Cu_{0.1}Nb_{14}B_8C_1$ | 0.3 | 60 | ○ | 5.3 | 4.7 | 5.4 | 7.9 | 1.47 | 1.21 |
| Ex. 32 | $Fe_{83.9}Cu_{0.1}Nb_7B_8C_1$ | 0.3 | 60 | ○ | 4.5 | 3.8 | 4.3 | 7.4 | 1.43 | 1.32 |
| Ex. 33 | $Fe_{83}Cu_1Nb_7B8C_1$ | 0.3 | 60 | ○ | 5.3 | 3.7 | 4.4 | 7.6 | 1.44 | 1.35 |
| Ex. 34 | $Fe_{88.4}Cu_{0.1}Nb_7B_{3.5}C_1$ | 0.3 | 60 | ○ | 10 | 9.6 | 12 | 7.3 | 1.67 | 1.32 |
| Ex. 35 | $Fe_{83.9}Cu_{0.1}Nb_7B_7C_1$ | 0.3 | 60 | ○ | 4.5 | 3.9 | 5.3 | 7.3 | 1.43 | 1.34 |
| Ex. 36 | $Fe_{80.9}Cu_{0.1}Nb_7B_{11}C_1$ | 0.3 | 60 | ○ | 6.3 | 6.2 | 8.3 | 7.8 | 1.24 | 1.36 |
| Ex. 37 | $Fe_{74.9}Cu_{0.1}Nb_7B_{17}C_1$ | 0.3 | 60 | ○ | 7.8 | 7.9 | 9.3 | 7.3 | 1.15 | 1.34 |
| Ex. 38 | $Fe_{90}Zr_7B_2C_1$ | 0.3 | 60 | ○ | 6.3 | 6.5 | 7.9 | 7.4 | 1.72 | 1.34 |
| Ex. 39 | $Fe_{89}Zr_7B_3C_1$ | 0.3 | 60 | ○ | 4.3 | 3.8 | 7.3 | 7.6 | 1.68 | 1.39 |
| Ex. 40 | $Fe_{88}Zr_7B_3Cu_1C_1$ | 0.3 | 60 | ○ | 4.1 | 4.2 | 5.7 | 7.3 | 1.71 | 1.43 |
| Ex. 41 | $Fe_{89}Hf_7B_3C1$ | 0.3 | 60 | ○ | 5.7 | 5.3 | 6.7 | 7.5 | 1.72 | 1.33 |
| Ex. 42 | $Fe_{88}Hf_7B_4C_1$ | 0.3 | 60 | ○ | 5.5 | 4.3 | 5.9 | 7.7 | 1.66 | 1.34 |
| Ex. 43 | $Fe_{87}Hf_7B_3Cu_1C_1$ | 0.3 | 60 | ○ | 5.3 | 3.2 | 4.6 | 7.6 | 1.72 | 1.38 |
| Ex. 44 | $Fe_{83}Nb_{3.5}Zr_{3.5}B_8Cu_1C_1$ | 0.3 | 60 | ○ | 4.5 | 2.4 | 3.5 | 6.9 | 1.43 | 1.33 |
| Ex. 45 | $Fe_{83}Nb_{3.5}Hf_{3.5}B_8Cu_1C_1$ | 0.3 | 60 | ○ | 3.8 | 2.6 | 4.5 | 73 | 1.43 | 1.45 |
| Ex. 46 | $Fe90.9Nb_6B_3C_{0.1}$ | 0.3 | 60 | ○ | 5.3 | 5.8 | 6.8 | 7.2 | 1.66 | 1.32 |
| Ex. 49 | $Fe_{90.9}Nb_{1.98}B_{2.97}C_4$ | 0.3 | 60 | ○ | 5.8 | 5.2 | 5.6 | 5.2 | 1.77 | 1.76 |
| Ex. 53 | $Fe_{80.8}Nb_{6.7}B_{8.65}C_{3.85}$ | 0.3 | 60 | ○ | 4.3 | 2.9 | 6.5 | 5.8 | 1.25 | 1.44 |
| Ex. 54 | $Fe_{77.9}Nb_{14}B_8C_{0.1}$ | 0.3 | 60 | ○ | 8.3 | 7.5 | 8.5 | 12.5 | 1.43 | 1.44 |
| Ex. 55 | $Fe_{75}Nb_{13.5}B_{7.5}C_4$ | 0.3 | 60 | ○ | 4.6 | 3.3 | 5.6 | 5.5 | 1.33 | 1.23 |
| Ex. 56 | $Fe_{78}Nb_1B_{17}C_4$ | 0.3 | 60 | ○ | 11 | 10 | 12 | 5.2 | 1.19 | 1.89 |
| Ex. 57 | $Fe_{78}Nb_1B_{20}C_1$ | 0.3 | 60 | ○ | 11 | 9.8 | 13 | 7.4 | 1.16 | 1.99 |

TABLE 4

| Sample No. | Composition | Release Injection Pressure (MPa) | Heat Treatment Time (min) | Fe Network Phase | Coercive Force Hc(A/m) −50° C. | suitable temperature | +50° C. | Low Fe and High C Grid C times suitable temperature | B times suitable temperature | M times suitable temperature |
|---|---|---|---|---|---|---|---|---|---|---|
| Ex. 58 | $Fe_{79.5}Cu_1Nb_2Si9.5B_9C_1$ | 0.3 | 60 | ○ | 1.58 | 1.47 | 1.64 | 7.5 | 1.32 | 1.55 |
| Ex. 59 | $Fe_{79}Cu_1Nb_2Si_9B_5C_4$ | 0.3 | 60 | ○ | 1.55 | 1.43 | 1.66 | 5.8 | 1.23 | 1.54 |
| Ex. 60 | $Fe_{73.5}Cu_1Nb_3Si_{13.5}B_8C_1$ | 0.3 | 60 | ○ | 0.87 | 0.77 | 1.02 | 7.9 | 1.34 | 1.43 |
| Ex. 61 | $Fe_{73.5}Cu_1Nb_3Si_{13.5}B_5C_4$ | 0.3 | 60 | ○ | 1.21 | 1.01 | 1.23 | 5.3 | 1.27 | 1.34 |
| Ex. 62 | $Fe_{69.5}Cu_1Nb_3Si_{17.5}B_8C_1$ | 0.3 | 60 | ○ | 1.45 | 1.21 | 1.45 | 7.5 | 1.38 | 1.45 |
| Ex. 63 | $Fe_{69.5}Cu_1Nb_3Si_{17.5}B_5C_4$ | 0.3 | 60 | ○ | 1.44 | 1.31 | 1.34 | 5.4 | 1.26 | 1.34 |
| Ex. 64 | $Fe_{79}Cu_1Nb_2Si_9B_5C_4$ | 0.3 | 60 | ○ | 3.54 | 3.21 | 3.65 | 5.3 | 1.28 | 1.34 |
| Ex. 65 | $Fe_{75.9}Cu_{0.1}Nb_2Si_9B_9C_4$ | 0.3 | 60 | ○ | 3.76 | 3.43 | 3.56 | 5.2 | 1.45 | 1.56 |

TABLE 4-continued

| Sample No. | Composition | Release Injection Pressure (MPa) | Heat Treatment Time (min) | Fe Network Phase | Coercive Force Hc(A/m) −50° C. | Coercive Force Hc(A/m) suitable temperature | Coercive Force Hc(A/m) +50° C. | Low Fe and High C Grid C times suitable temperature | Low Fe and High C Grid B times suitable temperature | Low Fe and High C Grid M times suitable temperature |
|---|---|---|---|---|---|---|---|---|---|---|
| Ex. 66 | $Fe_{75.5}Cu_{0.5}Nb_2Si_9B_9C_4$ | 0.3 | 60 | ○ | 3.78 | 3.45 | 3.98 | 5.7 | 1.49 | 1.53 |
| Ex. 67 | $Fe_{74.5}Cu_{1.5}Nb2Si_9B_9C_4$ | 0.3 | 60 | ○ | 4.68 | 4.32 | 5.01 | 5.3 | 1.46 | 1.34 |
| Ex. 68 | $Fe_{74}Cu_3Nb_1Si_9B_9C_4$ | 0.3 | 60 | ○ | 6.23 | 5.34 | 5.98 | 5.6 | 1.40 | 1.67 |
| Ex. 69 | $Fe_{75}Cu_1Nb_2Si_9B_9C_4$ | 0.3 | 60 | ○ | 5.88 | 5.41 | 5.67 | 5.3 | 1.44 | 1.45 |
| Ex. 70 | $Fe_{72}Cu_1Nb_5Si_9B_9C_4$ | 0.3 | 60 | ○ | 6.78 | 6.43 | 7.34 | 5.8 | 1.46 | 1.37 |
| Ex. 71 | $Fe_{86.9}Cu_{0.1}P_1Si_2B_9C_1$ | 0.3 | 60 | ○ | 5.21 | 4.56 | 5.76 | 7.5 | 1.43 | 7.32 |
| Ex. 72 | $Fe_{80.9}Cu_{0.1}P_1S_{i8}B_9C_1$ | 0.3 | 60 | ○ | 3.77 | 3.21 | 4.23 | 7.4 | 1.33 | 7.24 |
| Ex. 73 | $Fe_{82.9}Cu_{0.1}P_2Si_2B_9C_4$ | 0.3 | 60 | ○ | 5.78 | 5.32 | 6.01 | 5.3 | 1.43 | 6.23 |
| Ex. 74 | $Fe_{76.9}Cu_{0.1}P_2Si_8B_9C_4$ | 0.3 | 60 | ○ | 2.78 | 2.45 | 3.32 | 5.4 | 1.47 | 6.23 |
| Ex. 75 | $Fe_{72.5}Cu_1Nb_2Si_{11.5}B_9C_4$ | 0.3 | 60 | ○ | 1.78 | 1.45 | 2.03 | 5.6 | 1.45 | 1.45 |
| Ex. 76 | $Fe_{78}Cu_1Nb_2Si_9B_6C_4$ | 0.3 | 60 | ○ | 2.34 | 1.89 | 2.67 | 5.2 | 1.33 | 1.32 |
| Ex. 77 | $Fe_{73}Cu_1Nb_2Si_9B_{11}C_4$ | 0.3 | 60 | ○ | 2.65 | 1.65 | 2.22 | 5.7 | 1.25 | 1.43 |
| Ex. 78 | $Fe_{71}Cu_1Nb_2Si_9B_{13}C_4$ | 0.3 | 60 | ○ | 2.55 | 1.43 | 2.67 | 5.2 | 1.21 | 1.47 |
| Ex. 79 | $Fe_{78.9}Cu_1Nb_2Si_9B_9C_{0.1}$ | 0.3 | 60 | ○ | 2.78 | 1.86 | 3.21 | 12.3 | 1.43 | 1.34 |

From Tables 3 and 4, it can be seen that soft magnetic alloys heat treated at the suitable temperature by varying the composition within an appropriate range have an average C content ratio in the low Fe high C grid which is 5.0 times or more the average C amount of the whole soft magnetic alloy. In Examples in which the average C content ratio in the low Fe and high C grid was 5.0 times or more the average C content ratio of the whole soft magnetic alloy, the coercive force was all good.

Experiment 4

Experiments were conducted under the same conditions as in Ex. 22, except kind of M was varied. Experiments were also conducted under the same conditions as in Ex. 69, except kind of M was varied. Results are shown in Tables 5 and 6.

TABLE 5

| Sample No. | Composition | Release Injection Pressure (MPa) | Heat Treatment Time (min) | Fe Network Phase | Coercive Force Hc(A/m) 550° C. | Coercive Force Hc(A/m) 600° C. | Coercive Force Hc(A/m) 650° C. | Low Fe and High C Grid C times | Low Fe and High C Grid B times 600° C. | Low Fe and High C Grid M times |
|---|---|---|---|---|---|---|---|---|---|---|
| Ex. 22 | $Fe_{83}Nb_7B_9C_1$ | 0.3 | 60 | ○ | 5.8 | 5.4 | 6.3 | 7.3 | 1.46 | 1.35 |
| Ex. 22a | $Fe_{83}Ti_7B_9C_1$ | 0.3 | 60 | ○ | 13 | 12 | 11 | 7.1 | 1.44 | 1.34 |
| Ex. 22b | $Fe_{83}V_7B_9C_1$ | 0.3 | 60 | ○ | 15 | 13 | 11 | 7.2 | 1.45 | 1.35 |
| Ex. 22c | $Fe_{83}Ta_7B_9C_1$ | 0.3 | 60 | ○ | 13 | 11 | 12 | 7.1 | 1.47 | 1.32 |
| Ex. 22d | $Fe_{83}Mo_7B_9C_1$ | 0.3 | 60 | ○ | 12 | 12 | 13 | 7.1 | 1.46 | 1.36 |
| Ex. 22e | $Fe_{83}P_7B_9C_1$ | 0.3 | 60 | ○ | 7.1 | 6.8 | 7.1 | 7.3 | 1.47 | 1.37 |
| Ex. 22f | $Fe_{83}Cr_7B_9C_1$ | 0.3 | 60 | ○ | 7.5 | 7.5 | 7.9 | 7.4 | 1.48 | 1.39 |

TABLE 6

| Sample No. | Composition | Release Injection Pressure (MPa) | Heat Treatment Time (min) | Fe Network Phase | Coercive Force Hc(A/m) −50° C. | Coercive Force Hc(A/m) suitable tempuratur | Coercive Force Hc(A/m) +50° C. | Low Fe and High C Grid C times suitable temperature | Low Fe and High C Grid B times suitable temperature | Low Fe and High C Grid M times suitable temperature |
|---|---|---|---|---|---|---|---|---|---|---|
| Ex. 69 | $Fe_{75}Cu_1Nb_2Si_9B_9C_4$ | 0.3 | 60 | ○ | 5.88 | 5.41 | 5.67 | 5.3 | 1.44 | 1.45 |
| Ex. 69a | $Fe_{75}Cu_1Ti_2Si_9B_9C_4$ | 0.3 | 60 | ○ | 7.1 | 7.2 | 7.8 | 5.2 | 1.44 | 1.42 |
| Ex. 69b | $Fe_{75}Cu_1Zr_2Si_9B_9C_4$ | 0.3 | 60 | ○ | 5.3 | 5.4 | 6.1 | 5.1 | 1.43 | 1.43 |
| Ex. 69c | $Fe_{75}Cu_1Hf_2Si_9B_9C_4$ | 0.3 | 60 | ○ | 7.4 | 7.8 | 7.8 | 5.7 | 1.45 | 1.45 |
| Ex. 69d | $Fe_{75}Cu_1V_2Si_9B_9C_4$ | 0.3 | 60 | ○ | 7.5 | 7.9 | 8.3 | 5.3 | 1.45 | 1.43 |
| Ex. 69e | $Fe_{75}Cu_1Ta_2Si_9B_9C_4$ | 0.3 | 60 | ○ | 8.1 | 8.2 | 8.9 | 5.1 | 1.47 | 1.42 |
| Ex. 69f | $Fe_{75}Cu_1Mo_2Si_9B_9C_4$ | 0.3 | 60 | ○ | 7.2 | 7.3 | 8.1 | 5.3 | 1.48 | 1.47 |
| Ex. 69g | $Fe_{75}Cu_1Cr_2Si_9B_9C_4$ | 0.3 | 60 | ○ | 7.3 | 7.5 | 8.2 | 5.3 | 1.43 | 1.43 |
| Ex. 69h | $Fe_{75}Cu_1Nb_1Cr_1Si_9B_9C_4$ | 0.3 | 60 | ○ | 7.4 | 7.2 | 8.3 | 5.2 | 1.48 | 1.50 |
| Ex. 69i | $Fe_{80}Nb_7B_9P_3C_1$ | 0.3 | 60 | ○ | 3.6 | 3.4 | 3.8 | 7.1 | 1.43 | 1.37 |
| Ex. 69j | $Fe_{76}Nb_7B_9P_3C_4$ | 0.3 | 60 | ○ | 4.1 | 4.2 | 4.8 | 5.3 | 1.47 | 1.37 |
| Ex. 69k | $Fe_{79}Nb_7B_9P_3Si_1C_1$ | 0.3 | 60 | ○ | 3 | 2.7 | 3.6 | 7.3 | 1.45 | 1.38 |
| Ex. 69l | $Fe_{77}Nb_7B_9P_3Si_3C_1$ | 0.3 | 60 | ○ | 3.1 | 2.8 | 3.7 | 7.4 | 1.46 | 1.34 |

TABLE 6-continued

| Sample No. | Composition | Release Injection Pressure (MPa) | Heat Treatment Time (min) | Fe Network Phase | Coercive Force Hc(A/m) −50° C. | suitable tempuratur | +50° C. | Low Fe and High C Grid C times | B times | M times |
|---|---|---|---|---|---|---|---|---|---|---|
| | | | | | | suitable temperature | | | | |
| Ex. 69m | $Fe_{75}Nb_7B_9P_3Si_5C_1$ | 0.3 | 60 | ○ | 2.9 | 2.6 | 3.2 | 7.2 | 1.43 | 1.38 |
| Ex. 69n | $Fe_{79}Nb_7B_9P_3C_1Cu_1$ | 0.3 | 60 | ○ | 2.9 | 2.6 | 3.1 | 7.3 | 1.47 | 1.37 |
| Ex. 69o | $Fe_{78}Nb_7B_9P_3Si_1C_1Cu_1$ | 0.3 | 60 | ○ | 3.1 | 3.4 | 3.6 | 7.3 | 1.43 | 1.36 |

From Tables 5 and 6, it can be seen that soft magnetic alloys heat treated at the suitable temperature by varying the composition within an appropriate range have an average C content ratio in the low Fe and high C grid which is 5.0 times or more the average C amount of the whole soft magnetic alloy. In Examples in which the average C content ratio in the low Fe and high C grid was 5.0 times or more the average C content ratio of the whole soft magnetic alloy, the coercive force was all good.

Experiment 5

Each pure metal material was weighed and obtained a mother alloy having the following composition: Fe:73.5 atom %, Si:13.5 atom %, B:8.0 atom %, Nb:3.0 atom %, Cu:1.0 atom % and C:1.0 atom %. After vacuum evacuation in the chamber, the pure metal materials were melted by high frequency heating and prepared the mother alloy.

Thereafter, the prepared mother alloy was heated and melted to obtain a metal in a molten state of 1300° C. Then the metal was injected by a composition condition shown in the following Table 7 by a gas atomization method and prepared a powder. In Experiment 5, the gas injection temperature was set to 100° C. and the vapor pressure in the chamber was set to 4 hPa to prepare a sample. The steam pressure adjustment was carried out by using Ar gas, which was subjected to dew point adjustment.

Each powder before heat treatment was subjected to X-ray diffraction measurement to confirm the presence or absence of crystals. As a result, it was confirmed that crystals were not present in each powder and the powders were completely amorphous.

Subsequently, the obtained each powder was subjected to heat treatment, then coercive force Hc thereof was measured. Then, the average C content ratio in Fe composite network and in low Fe and high C grid with respect to the average C content ratio in the whole soft magnetic alloy was measured. Considering the heat treatment temperature, the suitable temperature was 550° C. for the samples of Fe—Si-M1-B—Cu—C based composition (Comp. Ex. 80 and Ex. 81), and the suitable temperature was 600° C. for the samples of Fe-M2-B—C based composition (Comp. Ex. 82 and Ex. 83). Heat treatment time was one hour. In Experiment 5, for samples having Fe—Si-M1-B—Cu—C based composition, coercive force Hc at plus or minus 50° C. of the suitable temperature of 50 A/m or less was determined good. And for samples having Fe-M2-B—C based composition, coercive force Hc at plus or minus 50° C. of the suitable temperature of 100 A/m or less was determined good.

TABLE 7

| Sample No. | Composition | Fe Network Phase | Coercive Force Hc(A/m) −50° C. | suitable temperatur | + 50° C. | Low Fe and High C Grid C times | B times | M times |
|---|---|---|---|---|---|---|---|---|
| | | | | suitable temperature | | | | |
| Comp. Ex. 80 | $Fe_{73.5}Cu_1Nb_3Si_{13.5}B_9$ | ○ | 35 | 24 | 185 | — | 1.32 | 1.42 |
| Ex. 81 | $Fe_{73.5}Cu_1Nb_3SiB_8C_1$ | ○ | 25 | 22 | 34 | 7.9 | 1.34 | 1.43 |
| Comp. Ex. 82 | $Fe_{84}Nb_7B_9$ | ○ | 184 | 98 | 267 | — | 1.52 | 1.37 |
| Ex. 83 | $Fe_{84}Nb_7B_8C_1$ | ○ | 98 | 88 | 99 | 7.3 | 1.55 | 1.33 |

Comparing the comparative example and the example shown in Table 7, it was found that by performing heat treatment on amorphous soft magnetic alloy powder, Fe composite network structure can be obtained similar to the ribbon. And further, coercive force Hc tends to be small similar to the ribbon in Experiments 1 to 4, when heat treatment temperature at which coercive force becomes minimum is set to a suitable temperature, and the average C content ratio, in low Fe and high C grid at the suitable temperature with coercive force Hc at plus or minus 50° C. of the suitable temperature, is 5.0 times or more the average C content ratio of the whole soft magnetic alloy.

NUMERICAL REFERENCES

10 . . . Grid
- 10*a* . . . Maximum point
- 10*b* . . . Adjacent grid

20*a* . . . Area having Fe content ratio higher than the threshold value

20*b* . . . Area having Fe content ratio of the threshold value or less

31 . . . Nozzle
32 . . . Molten metal
33 . . . Roll
34 . . . Ribbon
35 . . . Chamber
36 . . . Peel gas injector

The invention claimed is:

1. A soft magnetic alloy comprising Fe, as a main component, and comprising C, wherein a composition of the soft magnetic alloy is $Fe_aCu_bM1_cSi_dB_eC_f$, in which a+b+c+d+e+f=100, 0.1≤b≤3.0, 1.0≤c≤10.0, 0.0≤d≤17.5, 6.0≤e≤13.0, and 0.0<f≤4.0, and M1 is one or more selected from a group consisting of Nb, Ti, Zr, Hf, V, Ta, Mo, P and Cr, the soft magnetic alloy comprises an Fe composite network phase having Fe-rich grids connected in a continuous measurement range including 80000 grids, each of which size is 1 nm×1 nm×1 nm, Fe content ratio of each of the Fe-rich grids is higher than an average of Fe content ratio of the whole soft magnetic alloy, the continuous measurement range includes Fe-poor grids among the 80000 grids, Fe content ratio of each of the Fe-poor grids is less than the average of Fe content ratio of the whole soft magnetic alloy, and an average of C content ratio of the Fe-poor grids having cumulative frequency of 90% or more is 5.1 times or more and 12.5 times or less to an average of C content ratio of the whole soft magnetic alloy.

2. The soft magnetic alloy according to claim 1, wherein an average of M1 content ratio of the Fe-poor grids having cumulative frequency of 90% or more is 1.2 times or more to an average of M1 content ratio of the whole soft magnetic alloy.

3. The soft magnetic alloy according to claim 1, wherein the average of C content ratio of the whole soft magnetic alloy is 3 atom % or less.

4. The soft magnetic alloy according to claim 1, wherein an average of B content ratio of the Fe-poor grids having cumulative frequency of 90% or more is 1.2 times or more to an average of B content ratio of the whole soft magnetic alloy.

5. A magnetic device comprising the soft magnetic alloy according to claim 1.

6. The soft magnetic alloy according to claim 1, wherein 0.5≤b≤1.5, 3.0≤c≤5.0, 11.5≤d≤17.5 when M1 is not P, 9.0≤e≤11.0, and 0.1≤f≤4.0.

7. A soft magnetic alloy comprising Fe, as a main component, and comprising C, wherein a composition of the soft magnetic alloy is $Fe_\alpha M2_\beta B_\gamma C_\Omega$, in which α+β+γ+Ω=100, 1.0≤β≤15.0, 2.0≤γ≤20.0 and 0.0<Ω≤4.0, and M2 is one or more selected from a group consisting of Nb, Cu, Zr, Hf, Ti, V, Ta, Mo, P, Si and Cr, the soft magnetic alloy comprises an Fe composite network phase having Fe-rich grids connected in a continuous measurement range including 80000 grids, each of which size is 1 nm×1 nm×1 nm, Fe content ratio of each of the Fe-rich grids is higher than an average of Fe content ratio of the whole soft magnetic alloy, the continuous measurement range includes Fe-poor grids among the 80000 grids, Fe content ratio of each of the Fe-poor grids is less than the average of Fe content ratio of the whole soft magnetic alloy, and an average of C content ratio of the Fe-poor grids having cumulative frequency of 90% or more is 5.1 times or more and 12.5 times or less to an average of C content ratio of the whole soft magnetic alloy.

8. The soft magnetic alloy according to claim 7, wherein an average of M2 content ratio of the Fe-poor grids having cumulative frequency of 90% or more is 1.2 times or more to an average of M2 content ratio of the whole soft magnetic alloy.

9. The soft magnetic alloy according to claim 7, wherein the average of C content ratio of the whole soft magnetic alloy is 3 atom % or less.

10. The soft magnetic alloy according to claim 7, wherein an average of B content ratio of the Fe-poor grids having cumulative frequency of 90% or more is 1.2 times or more to an average of B content ratio of the whole soft magnetic alloy.

11. A magnetic device comprising the soft magnetic alloy according to claim 7.

12. The soft magnetic alloy according to claim 7, wherein 5.0≤b≤8.1, 2.0≤γ≤20.0 and 0.1≤Ω≤3.0.

13. The soft magnetic alloy according to claim 12, wherein 0.5<Ω≤1.0.

14. The soft magnetic alloy according to claim 12, wherein 4.5≤γ≤18.0 and M2 is Nb.

15. The soft magnetic alloy according to claim 12, wherein 2.0≤γ≤8.0 and M2 is Zr and/or Hf.

* * * * *